US006016970A

United States Patent [19]

Dupre

[11] Patent Number: 6,016,970

[45] **Date of Patent: *Jan. 25, 2000**

[54] SNOW MAKING TOWER

[76] Inventor: Herman K. Dupre, Seven Springs, Champion, Pa. 15622

[ * ] Notice: This patent is subject to a terminal disclaimer.

[21] Appl. No.: 09/163,067

[22] Filed: Sep. 28, 1998

Related U.S. Application Data

[63] Continuation-in-part of application No. 08/980,248, Nov. 28, 1997, abandoned, which is a continuation-in-part of application No. 08/911,240, Aug. 15, 1997, Pat. No. 5,890,654.

[51] Int. Cl.[7] ..... F25C 3/04; B05B 15/06

[52] U.S. Cl. ..... 239/14.2; 239/273; 239/276; 239/280; 239/280.5; 239/282; 248/219.4; 248/230.8

[58] Field of Search ..... 239/2.2, 14.2, 239/273, 276, 280, 280.5, 282, 283; 248/218.4, 219.4, 230.8, 230.9

[56] References Cited

U.S. PATENT DOCUMENTS

| | | | |
|---|---|---|---|
| 1,649,649 | 11/1927 | Bank . | |
| 2,984,444 | 5/1961 | Lewis | 248/166 |
| 3,061,201 | 10/1962 | Rienecker | 239/281 |
| 3,822,825 | 7/1974 | Dupre | 239/14.2 X |
| 3,952,949 | 4/1976 | Dupre | 239/2.2 |
| 4,199,103 | 4/1980 | Dupre | 239/14 |
| 5,004,151 | 4/1991 | Dupre | 239/2.2 |
| 5,360,163 | 11/1994 | Dupre | 239/14.2 |
| 5,667,137 | 9/1997 | Dupre | 239/14.2 |
| 5,810,251 | 9/1998 | McKinney | 239/2.2 |
| 5,908,156 | 6/1999 | Dupre | 239/14.2 |

*Primary Examiner*—Andres Kashnkow
*Assistant Examiner*—Robin O. Evans
*Attorney, Agent, or Firm*—Carothers & Carothers

[57] ABSTRACT

A snow making tower including a vertical ground support post having its bottom end anchored into the ground and a tower support pole is coaxially mounted on this ground support post for free axial rotation thereon. An upwardly extending support arm is secured intermediate its ends to the upper end of the tower support pole for pivotal movement from horizontal to vertical. An elongated pipe snow making tower is provided with snow making nozzles adjacent its upper end and supply connections at the lower end for connection to remote sources of air and water under pressure for supply thereof to the nozzles for discharge into ambient atmosphere for manufacturing snow in subfreezing conditions. The elongated snow making pipe tower is pivotally secured intermediate its ends to the upper end of the support arm for pivotal movement in a vertical plane from parallel alignment with the support arm to positions below horizontal. The support arm is provided with spaced upper and lower sleeves mounted thereon which slidably receive a lower portion of the elongated tower pipe therein for adjustable parallel extension or retraction relative to the support arm. A lock is provided in the sleeves for locking the tower pipe in the desired position. A retainer line of adjustable length connects the lower end of the support arm to the tower support pole for retaining the tower at a desired angle relative to vertical. The lower sleeve is detachably secured to the lower end of the support arm for releasing the lower sleeve together with the lower end of the tower pipe for pivoting the tower pipe about its pivot connection to the upper end of the support arm.

13 Claims, 6 Drawing Sheets

SNOW MAKING TOWER

CROSS REFERENCE

This application is a continuation-in-part of U.S. application Ser. No. 08/980,248 filed Nov. 28, 1997 now abnd which is a continuation-in-part of U.S. application Ser. No. 08/911,240, filed on Aug. 15, 1997 and now U.S. Pat. No. 5,890,654, for SNOW MAKING TOWER.

BACKGROUND OF THE INVENTION

This invention relates generally to fluid sprinkling and more specifically to snow making towers for ski slopes.

More particularly, this invention pertains to improvements in snow making towers of the type disclosed in my U.S. Pat. No. 5,360,163, issued Nov. 1, 1994, for ADJUSTABLE SNOW MAKING TOWER. This patent discloses an adjustable snow making tower which includes a vertical ground support post that is anchored into the ground and has a tower support pole coaxially received on this ground support post for support of a snow tower for axial and horizontal rotation on the ground support post.

This prior art device includes a support arm that is pivotally connected intermediate its opposite ends to the upper end of the tower support post for pivotal movement substantially from horizontal to vertical. In turn, an elongated pipe snow making tower having air and water discharge nozzles at its upper end and air and water supply connections at its lower end, is secured at its lower end portion to this support arm for pivotal movement with the support arm in a vertical plane. This configuration permits fill adjustability in the horizontal and vertical planes.

A jack mechanism is provided between the support arm and the tower support pole to raise and lower the support arm along with its attached snow making tower to desired vertical positions.

Problems encountered with lean-out towers of this type is that to be effective such towers must be at least 20 feet high and therefore the pipe of which the tower is constructed must be heavy duty, four inches ID or greater. This is required in order to support the suspended weight of the tower itself and to further accommodate the relatively large thrusts applied to the tower by the discharge of air and water under pressure through the nozzles at the top of the tower.

In addition, maximum loft, throw and spreading of manufactured snow is not accomplished because the nozzles cannot be positioned at optimum angles when the tower is leaned outwardly over a ski trail.

Also, adjustable lean-out towers of the prior art require expensive and relatively heavy duty jack mechanisms to raise and lower the tower to desired vertical positions.

The present invention also pertains to improvements in the snow making tower disclosed in the above-referenced copending cross reference. While the invention disclosed therein has many needed advantages, it nevertheless illustrates a snow making tower structure which cannot be erected and raised with minimum physical effort and is provided with a support structure which is more expensive to manufacture than desired.

It is an object of the present invention to eliminate these aforedescribed disadvantages of the prior art snow making towers of the lean-out type.

SUMMARY OF THE INVENTION

In the snow making tower of the present invention, the elongated pipe snow making tower extends upwardly at an acute angle from vertical and is provided with snow making nozzles in the upper end portion of the tower. In conventional fashion, supply connections are provided at the lower end of the tower for connection to remote sources of air and water under pressure for supplying the same to the nozzles for discharge into ambient atmosphere for manufacturing snow in subfreezing conditions.

The present invention pertains to the support and mounting structure for the snow making tower and also to the particulars of the elongated pipe tower itself. The pipe tower described will be of the general type disclosed in the aforementioned cross reference. However, the support structure of the snow making tower of the present invention may be utilized to support any pipe snow making tower of known design.

The snow making tower of the present invention includes a substantially vertical ground support post having a bottom end anchored in the ground. A tower support pole is coaxially mounted on this ground support post for free axial rotation on the post. An upwardly extending support arm is secured intermediate its ends to the upper end of the tower support pole for pivotal movement substantially from horizontal to vertical. An elongated pipe snow making tower as previously described is in turn pivotally secured intermediate its ends to the upper end of this support arm for pivotal movement relative to the support arm in a vertical plane from parallel alignment with the support arm to positions below horizontal for providing easy access from the ground to the nozzles at the upper end of the tower.

The support arm is provided with spaced upper and lower sleeves that are mounted on top of the support arm and these sleeves slidably receive a lower portion of the elongated tower pipe for adjustable parallel extension and retraction relative to the support arm. A lock is provided in at least one of these sleeves for locking the tower pipe in position.

In normal operating conditions, the elongated pipe tower is secured in parallel alignment with the support arm.

The tower support pole is preferably constructed of a pipe cap that is coaxially received over the ground support post, and a retainer line of adjustable length, for example, a chain of adjustable connection length, is connected between the lower end of the support arm and the tower support pole for retaining the pipe tower with the support arm at a desired angle relative to vertical. This retainer line, for example, may consist of a chain with a retainer bracket for adjustably changing the point of connection of the chain to the tower support pole.

A lock is provided on the pipe cap support pole for locking the pipe cap relative to the ground support post.

A removable hoist mechanism may also be connected between the lower end of the support arm and the pipe cap for raising or lowering the support arm about its pivot to the pipe cap. Once the tower pipe has been installed, the hoist mechanism may be removed and used elsewhere.

The tower pipe pivotal connection to the upper end of the support arm is provided between the upper sleeve, which is coaxially received over the tower pipe, and the upper end of the support arm. The lower sleeve is detachably secured to the lower end of the support arm for releasing this lower sleeve and thereby releasing the lower end of the tower pipe for pivoting it about its pivot connection to the upper end of the support arm. The lower sleeve is detachably secured to the support arm with a removable pin connection.

45% to 50% of the tower weight and length is supported at its lower end from the two spaced sleeves mounted on top of the support arm, and a hand line is attached to the bottom end of the tower pipe. Accordingly, the lower sleeve may be detached from the support arm to permit the tower to pivot freely about the pivot point on the upper end of the support arm and this may be very easily controlled by the hand line. Because of the positioning of the upper pivot point relative to the tower pipe, it only requires approximately eight pounds pull on the hand line to pull the bottom end of the tower pipe back into position or in parallel alignment with the support arm.

This support mechanism of the present invention may be utilized with any type of snow making tower. However, the present invention further includes a unique coupling mechanism for snow making towers which include an air pipe coextending within the tower pipe and further wherein the tower pipe and the air pipe are provided in corresponding upper and lower segments which are connected together with couplings.

In accordance with the teachings of the present invention, adjacent ends of upper and lower aluminum pipe segments for the internal air pipe, which coextends within the outer water pipe or the snow making tower pipe, are compressed radially inward about their circumferences for thereby providing necked down pipe ends. These necked down pipe ends are then internally tapped to form threads and are threadably secured together with a steel nipple.

The outer tower pipe is also composed of aluminum and the tower pipe coupling adjacent ends of the upper and lower tower pipe segments is provided in the form of a threaded steel sleeve coupling. It is preferred that this coupling further be provided with unthreaded collars secured respectively to the upper and lower ends of the steel sleeve for confining adjacent ends of the tower pipe segments beyond threaded portions thereof for thereby strengthening the tower pipe coupling.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 1:
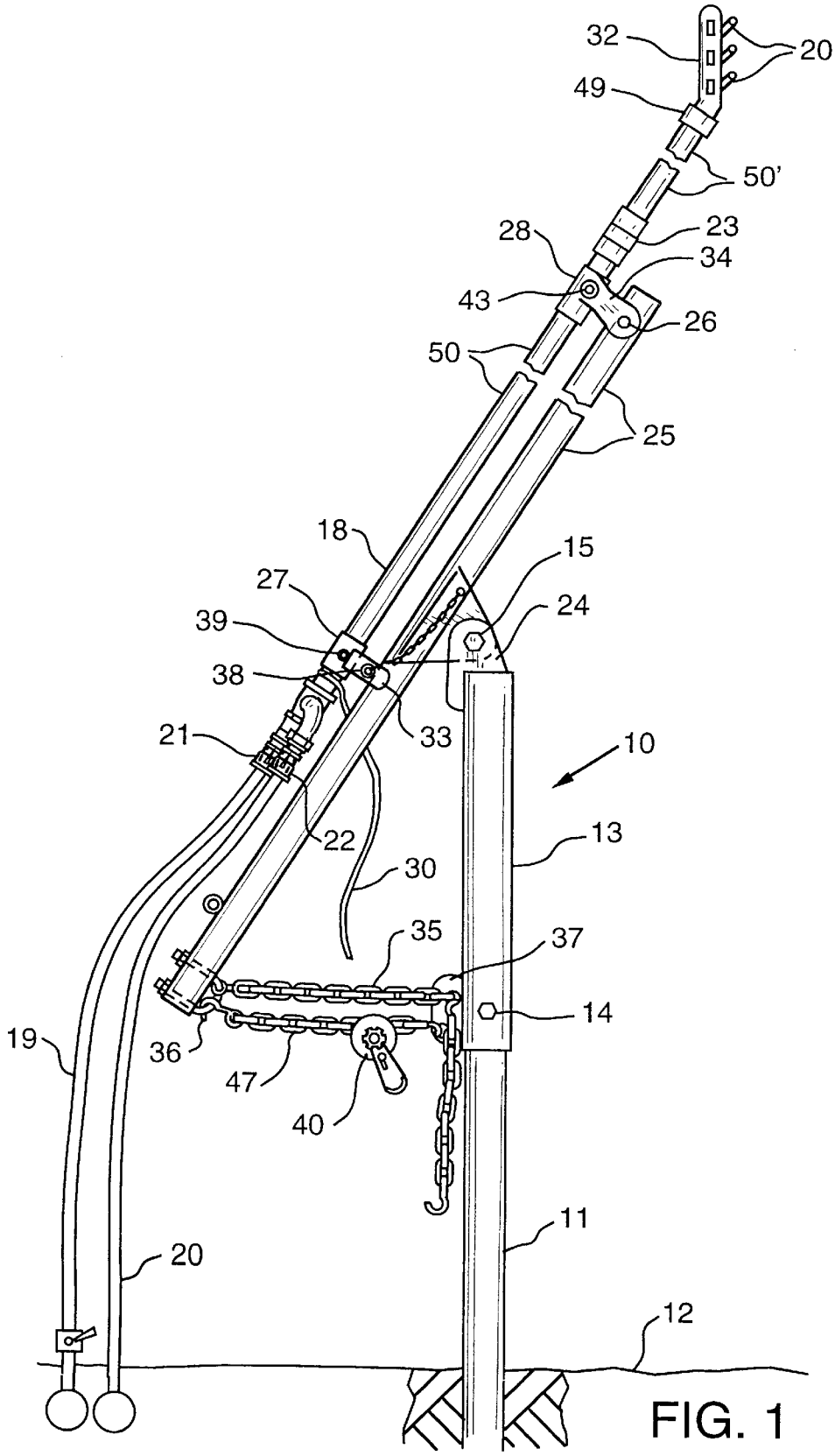
FIG. 1 is a view in side elevation of the snow making tower of the present invention.

Referring to the drawings, the snow making tower 10 of the present invention includes a substantially vertical ground support post 11 having the bottom end thereof anchored into ground surface 12. Tower support pole 13 is a pipe cap coaxially mounted on ground support post 11 for free axial rotation thereon for a full 360°.

Upwardly extending support arm 25 is pivotally support intermediate its ends to the upper end of tower support pole 13 at pivotal connection 15 for pivotal movement substantially from horizontal to vertical.

Elongated pipe snow making tower 18 is provided with snow making nozzles 20 adjacent the upper end of the tower at upper portion 32 and respective water and air connections 22 and 21 are provided at the lower end of tower 18 for connection to remote sources of air and water under pressure through the hoses 19 and 20 for supply to the nozzles 20 for discharge into ambient atmosphere for manufacturing snow in subfreezing conditions in a known fashion.

The elongated pipe snow making tower 18 itself is also pivotally secured intermediate its ends to the upper end of support arm 25 at pivotal connection 26 for movement in a vertical plane from parallel alignment with support arm 25 to positions below horizontal so that one may readily access the nozzles 20 from the ground for repair or exchange.

The support arm 25 vertically supports tower 18 at any desirable angle. However, tower 18 is preferably supported at 10° to 30° relative to vertical. In FIG. 1, the tower is illustrated as being supported at 30° relative to vertical.

Due to the length of tower 18, it will bow somewhat or sag and to compensate for this one may need to raise the tower closer to 10°. Also, in higher subfreezing ambient temperature conditions, it is also desirable to bring the tower 18 to an angle of 10° relative to vertical in order to provide more loft. This greater loft provides more dwell time for the atomized water crystals to form snow while falling to the underlying ski slope.

Support arm 25 is provided with spaced upper and lower sleeves 28 and 27 that are mounted on top of support arm 25 and slidably receive a lower portion 50 of elongated tower pipe 50 therein for adjustable parallel extension and/or retraction relative to support arm 25. Lock screws 43 and 39 are respectively provided in the sleeves for locking the tower pipe in position.

Support pole or pipe cap 13 is also provided with a lock bolt 14 which may be screwed down to lock pipe cap support pole 13 from relative rotation on top of support post 11.

When the tower 18 is being initially raised together with upper and lower tower pipe segments 50 and 50' and support arm 25, a removable hoist mechanism 40 is connected between the lower end of support arm 25 at connection 36 and pipe cap support pole 13 on retainer bracket 37 for raising or lowering the support arm about its pivot 15. Once this has been accomplished, chain 35 is slid into the upper opening and retainer plate or bracket 37 and the key hole slot engages chain 35 at the desired point of connection of the chain to maintain the selected angle of the support arm 25. The chain hoist 40 is then removed for use elsewhere.

The connector 36 is provided in the form of a muffler clamp which is readily available on the market and is easily secured to the lower end of support arm 25 by drilling the required openings through the pipe providing support arm 25 and applying nuts to the exposed ends of the muffler clamp.

The tower pipe pivotal connection 26 at the upper end of support arm 25 is provided as shown between upper sleeve 28 and support arm 25. Lower sleeve 27 is detachably secured to the lower end of support arm 25 for releasing the lower sleeve and thereby releasing the lower end of the tower pipe 50 for pivoting it about its pivot connection 26 at the upper end of support arm 25. Lower sleeve 27 is detachably secured to support arm 25 with removable pin 38 which is retained to the support arm by small chain 44 so that it is not lost. This detail is best seen in FIGS. 4 and 5.

Pin 38 penetrates the outer ears 33 which are welded at their upper ends to sleeve 27 and internally also slides through retainer sleeve 45 that is welded to the upper side of support arm 25 to maintain sleeve 27 in position.

Pin 38 is further provided with a pivoting end retainer 46 which prevents accidental dislodgement of pin 38.

Figure 3:
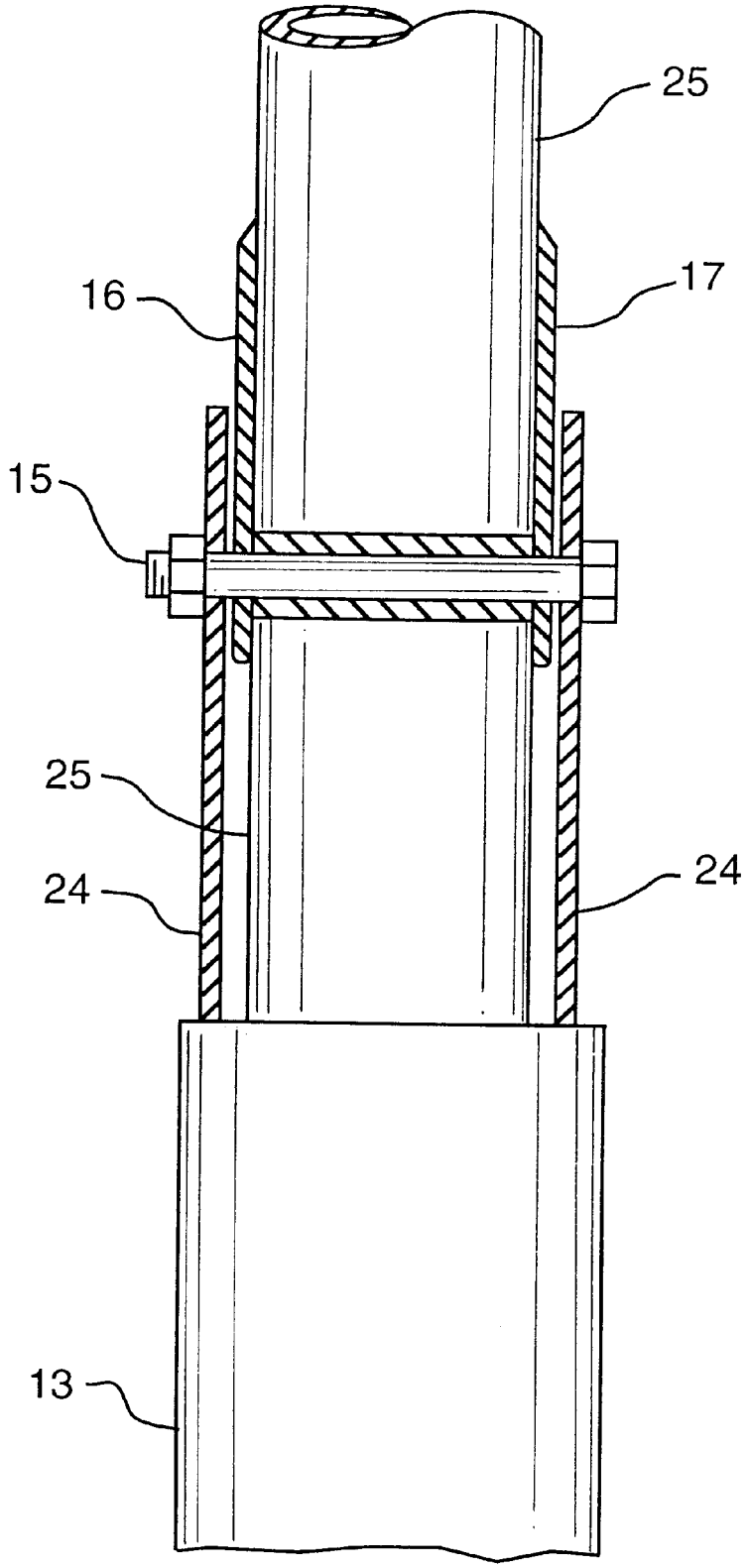
FIG. 3 is an enlarged view in front elevation of the snow making tower support structure shown in FIG. 2 as seen along section line III—III with central portions of the support structure shown in vertical mid cross section for exposing the internal relationship of the parts.
Figure 4:
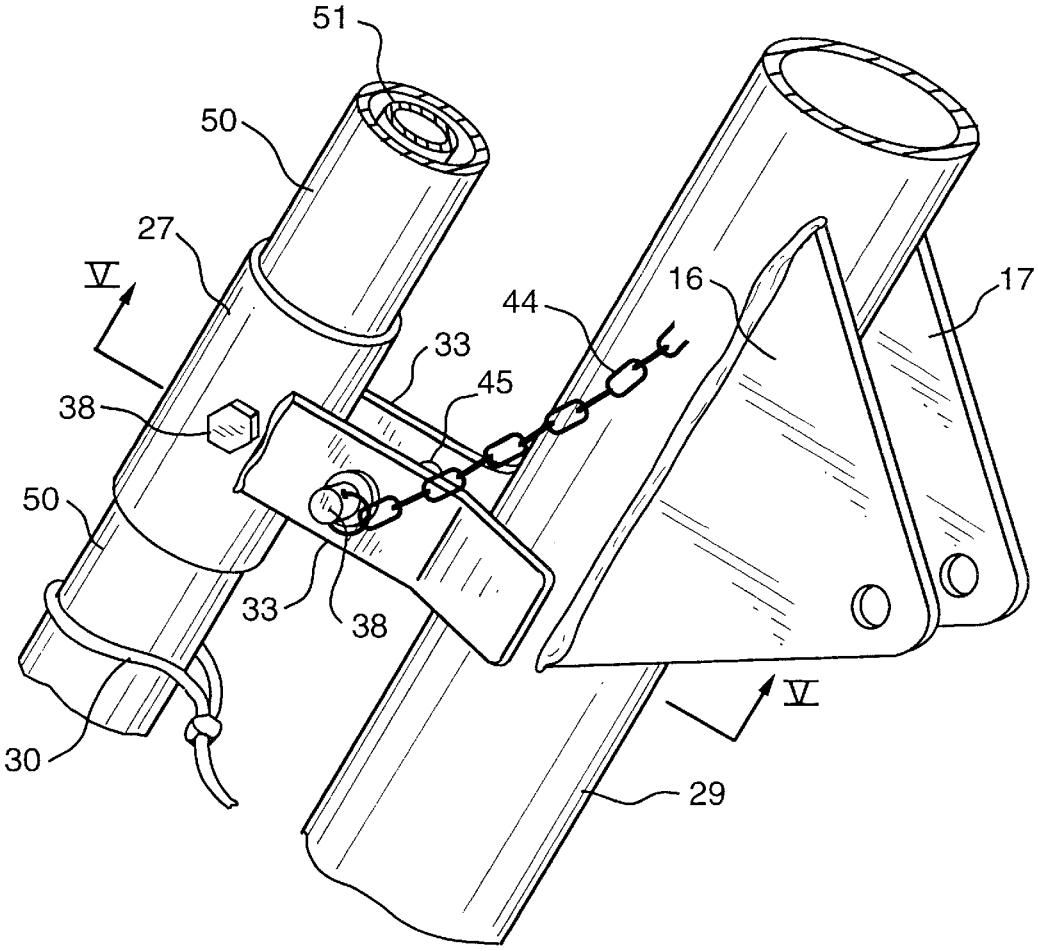
FIG. 4 is an enlarged perspective view showing the lower sleeve retainer for the lower end of the tower pipe structure shown in FIGS. 1 and 2.
Figure 5:
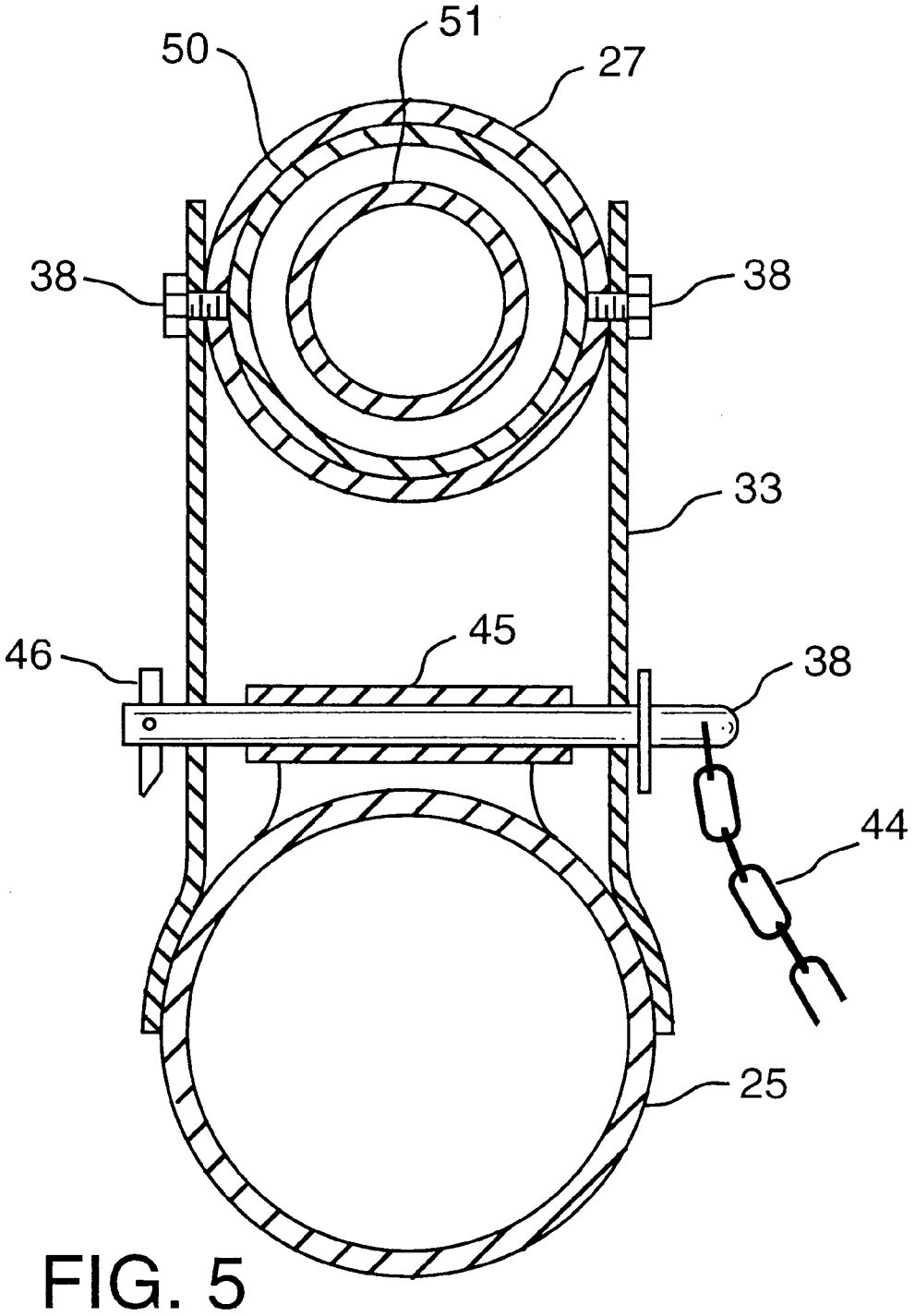
FIG. 5 is a cross sectional view of the structure shown in FIG. 4 as seen along section line V—V.

As is best illustrated in FIGS. 3 and 4, support for pivot 15 of the support arm 25 to pipe cap support pole 13 is provided by two aluminum cheek plates 16 and 17 which are welded to the sides of aluminum support arm 25, and additionally by spaced extending ears 24 which are steel plates welded to the upper end of pipe cap 13. The pivot connection is provided by the bolt indicated at 15 which passes through both cheek plates 16 and 17 and ears 24 to provide the appropriate pivot support. A tubular spacer is also provided for the pivot bolt 15 between ears 16 and 17 to maintain proper spacing of the cheek plates 16 and 17.

As can be seen from the drawings, approximately 45% to 50% of the lower end of tower pipe 50 is retained below the pivot point 26.

Accordingly, when pin 38 is removed, hand line 30 will easily manipulate the pivoting of tower pipe 50 about pivot point 26, as there is approximately no more than about eight pounds of pull on the line.

The pull cord or line 30 is connected between the bottom end of tower 18 and the bottom end of tower support pole or pipe cap 13. Line 30 may be of any flexible line such as a rope and its length is limited so that as tower 18 rotates clockwise (in this regard please see the aforementioned cross reference, the disclosure of which is incorporated herein by reference) pull line 30 will be stretched to its maximum length when the tower 18 is in its down position so that the operator may have access to the nozzles 20 from the ground surface 12 for easy replacement or repair access.

When maintenance has been accomplished and one wants to raise tower 18 once again to its operating position, the operator merely pulls on pull line 30 to bring tower 18 back into parallel alignment with support arm 25. At this point, retainer pin 38 is reinserted to secure tower 18 in this aligned parallel position with support arm 25.

Figure 2:
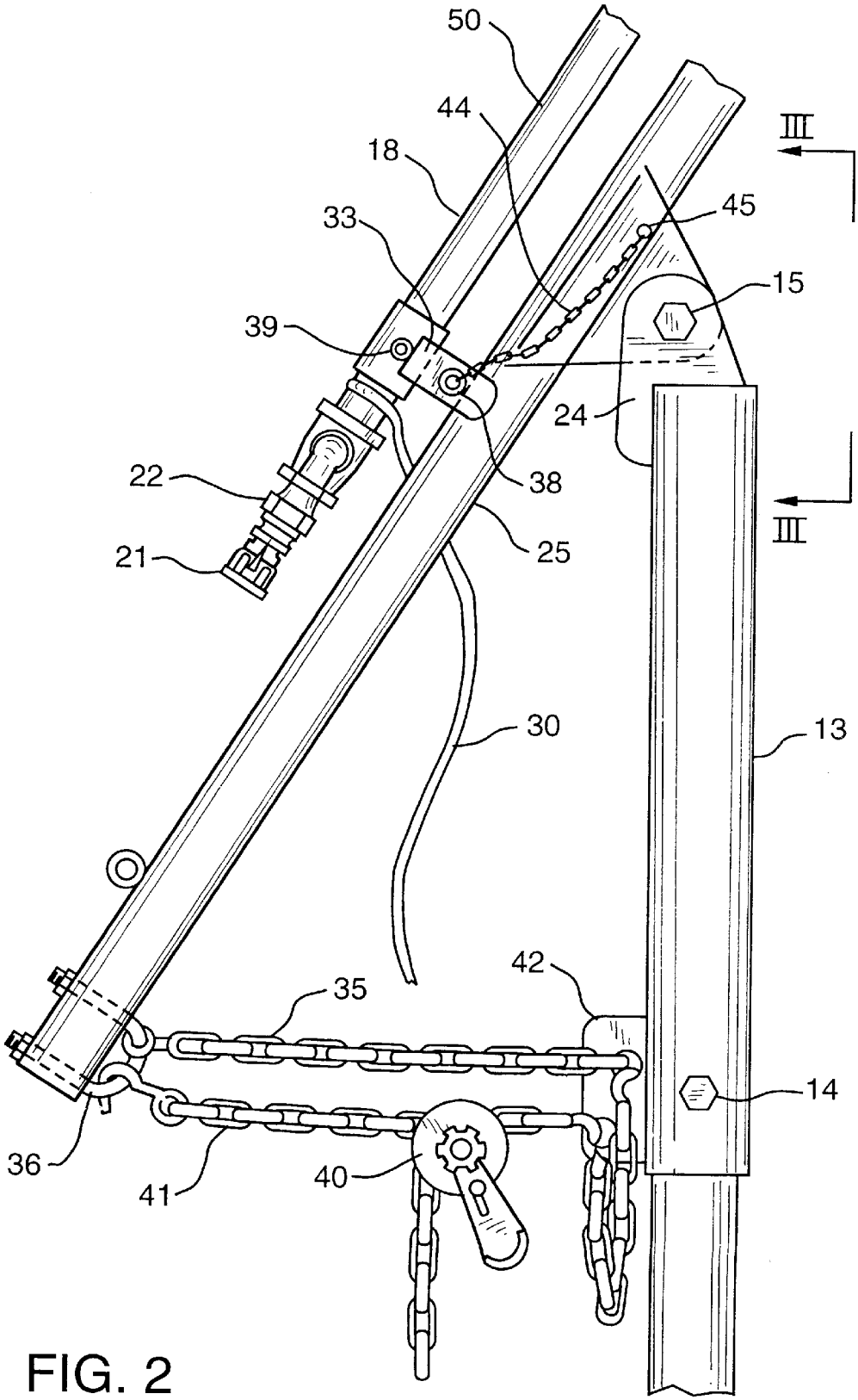
FIG. 2 is an enlarged view of the lower middle support section of the snow making tower shown in FIG. 1 with upper and lower portions removed.

The pivotal connection 15 of support arm 25 to the upper end of support pole 13 is offset to the side of tower support pole 13 as best illustrated in FIGS. 1 and 2. This permits the tower and support arm to be raised to full vertical and also permits ease of rotating the entire unit about ground support pole 11.

It is the aforedescribed features of the present invention which actually eliminate the need of any such expensive jack mechanism to raise and lower the snow tower of the present invention. The support mechanism of the snow tower of the present invention permits a single operator, or at worst, two operators to replace, remove and/or raise a snow making tower at a desired location as previously explained. The air and water nozzles 20 in the tower described operate in the same fashion as described in the parent specifications. In addition, the tower 18 is provided in two parts 50 and 50' which are interconnected with a coupling 23.

The snow tower 16 of the present invention includes an air pipe 51 coextending within tower pipe 50 and the tower pipe and the air pipe are provided in corresponding upper and lower segments 50 and 50', and 51 and 51', which are connected together with couplings 23 and 57.

Tower pipes 50 and 50', and air pipes 51 and 51' are composed of aluminum and the tower pipe coupling 23 is a threaded steel sleeve coupling adjacent externally threaded ends 55 and 56 of the lower and upper tower pipe segments 50 and 50'.

For the air pipe coupling 57, the lower and upper ends 55 and 56 of aluminum pipe segments 51 and 51' are pressed regularly inward about their circumferences to thereby neck down the ends 55 and 56 as illustrated.

Once these aluminum pipe ends have been necked down, they are internally tapped for threading and secured together with threaded steel nipple 57.

This coupling eliminates the need for expensive aluminum welding and provides a strong connection with minimal obstruction for the passage of air and water through the respective pipes.

Threaded steel sleeve 23 further includes unthreaded collars 54 and 53 which are respectively welded to the lower and upper ends of steel sleeve 23 so that they confine adjacent ends 55 and 56 of tower pipe segments 50 and 50' beyond the threaded portions thereof as illustrated for thereby strengthening the tower pipe coupling.

As noted in FIG. 1, the upper head portion 32 of the tower is detachable from the underlying portion of the tower 18 by means of coupling 49. Coupling 49 may be constructed in the same manner as couplings 23 and 57.

Figure 6:
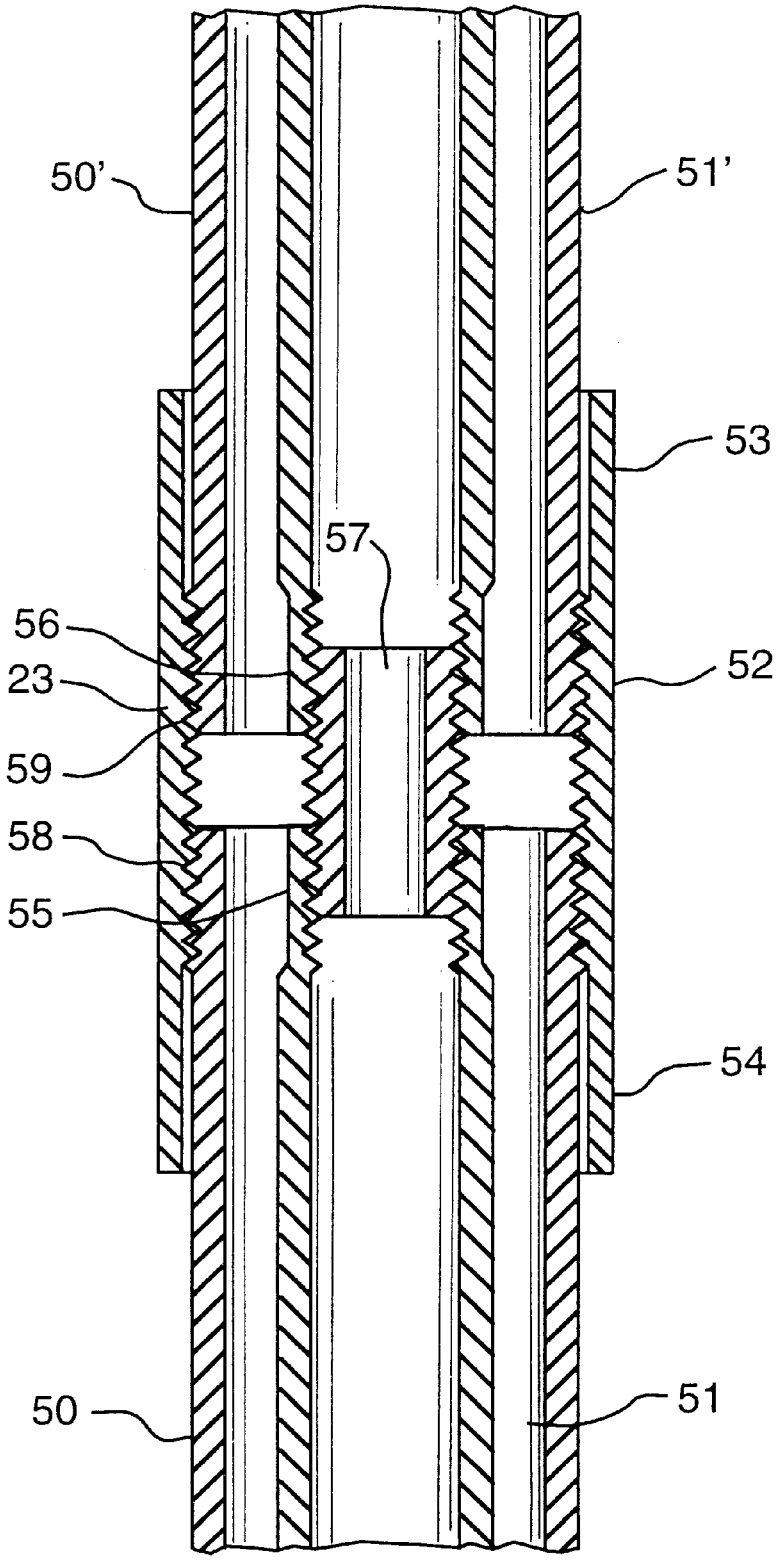
FIG. 6 is an enlarged view in vertical mid cross section illustrating the interior of the couplings connecting adjacent ends of upper and lower pipe segments for the tower pipe and internal air pipe of the tower structure shown in FIG. 1.

As an alternative, the external portion of coupling 49 may be a quick release coupling such as typically manufactured under the trademark EVERTITE and the internal coupling may be the same as illustrated at 57 in FIG. 6.

For details of the nozzle operation and the specifics for the construction of the tower 18, 50 itself, reference should be had to the afore referenced patents.

I claim:

1. A snow making tower comprising: a substantially vertical ground support post having a bottom end anchored in a ground surface, a tower support pole having upper and lower ends and coaxially mounted on said ground support post for support and free axial rotation thereon, an upwardly extending support arm having upper and lower ends and pivotally secured intermediate its ends to the upper end of said tower support pole for pivotal movement substantially from horizontal to vertical, an elongated snow making tower pipe having an upper end and a lower end with snow making nozzles adjacent the upper end of said tower pipe and supply connections at the lower end of said tower pipe for connection to remote sources of air and water under pressure for supply thereof to said nozzles for discharge into ambient atmosphere for manufacturing snow in sub-freezing conditions, said tower pipe pivotally secured intermediate its ends to the upper end of said support arm for pivotal movement in a vertical plane from parallel alignment with said support arm to positions below horizontal, said support arm having spaced upper and lower sleeves mounted thereon and slidably receiving a lower portion of said elongated tower pipe therein for adjustable parallel extension and retraction relative to said support arm, and a lock in at least one of said sleeves for locking said tower pipe in position.

2. The snow making tower of claim 1, said tower support post including a pipe cap supporting said support arm pivotal connection and coaxially received over said ground support post for free axial rotation thereon and a retainer line of adjustable length connected between the lower end of said support arm and said pipe cap for retaining said pipe tower at a desired angle relative to vertical.

3. The snow making tower of claim 2 wherein said retainer line is a chain with a retainer bracket for adjusting a point of connection of said chain to said pipe cap.

4. The snow making tower of claim 3 including a lock for locking said pipe cap relative to said support post.

5. The snow making tower of claim 3 including a removable hoist mechanism connected between the lower end of said support arm and said pipe cap for raising or lowering said support arm about its pivot to said pipe cap.

6. The snow making tower of claim 1 wherein said tower pipe pivotal connection to the upper end of said support arm is provided between said upper sleeve and said support arm.

7. The snow making tower of claim 6 wherein said lower sleeve is detachably secured to the lower end of said support arm for releasing said lower sleeve and thereby releasing the lower end of said tower pipe for pivoting about its pivot connection to the upper end of said support arm.

8. The snow making tower of claim 7 wherein said lower sleeve is detachably secured to said support arm with a removable pin connection.

9. The snow making tower of claim 1 wherein said tower includes an air pipe coextending within said tower pipe and said tower pipe and said air pipe are provided in corresponding upper and lower segments which are connected together with couplings, said air pipe and said tower pipe composed of aluminum, and said tower pipe coupling comprised of a threaded steel sleeve coupling adjacent externally threaded ends of said upper and lower tower pipe segments and said air pipe coupling comprised of a threaded steel nipple threadably connecting adjacent necked down internally threaded ends of said air pipe segments.

10. The snow making tower of claim 9 wherein said threaded steel sleeve coupling further includes unthreaded collars secured respectively to upper and lower ends of said steel sleeve for confining said adjacent ends of said tower pipe segments beyond threaded portions thereof for thereby strengthening said tower pipe coupling.

11. A snow making tower including an elongated snow making tower pipe supported for upward extension above ground and having upper and lower ends with snow making nozzles adjacent the upper end of said tower pipe and supply connections at the lower end of said tower pipe for connection to remote sources of air and water under pressure for supply thereof to said nozzles for discharge into ambient atmosphere for manufacturing snow in subfreezing conditions, said tower including an air pipe coextending within said tower pipe, said tower pipe and said air pipe provided in corresponding upper and lower segments which are connected together with couplings, said tower pipe and said air pipe composed of aluminum, the improvement comprising said air pipe coupling comprised of a threaded steel nipple threadably connecting adjacent necked down internally threaded ends of said air pipe segments.

12. The snow making tower of claim 11 wherein said coupling for said upper and lower tower pipe segments is a threaded steel sleeve coupling which further includes unthreaded collars secured respectively to upper and lower ends of said steel sleeve for confining said adjacent ends of said tower pipe segments beyond threaded portions thereof for thereby strengthening said tower pipe coupling.

13. A method of coupling adjacent ends of upper and lower aluminum pipe segments for an internal air pipe coextending within an outer water pipe of a snow making tower, the method comprising the steps of compressing said adjacent air pipe ends radially inward about their circumferences for thereby providing necked down ends, threadably internally tapping said necked down ends, and threadably securing said necked down ends together with a threaded steel nipple.

* * * * *